US005735748A

United States Patent [19]

Meyers et al.

[11] Patent Number: 5,735,748

[45] Date of Patent: Apr. 7, 1998

[54] ANGLE ADJUSTABLE TUBULAR WATERSLIDE

[76] Inventors: Janet D. Meyers, 432 W. Fletcher Dr., Orange, Calif. 92865; Robert C. Donnell, 12942 7th St., Garden Grove, Calif. 92640

[21] Appl. No.: 652,228

[22] Filed: May 23, 1996

Related U.S. Application Data

[63] Continuation-in-part of Ser. No. 420,144, Apr. 11, 1995, abandoned.

[51] Int. Cl.[6] ..... A63G 21/18

[52] U.S. Cl. ..... 472/117; 472/116

[58] Field of Search ..... 472/13, 116, 117, 472/128; 104/69, 70; 182/48, 49; D21/241, 242, 243, 245; 482/35, 36

[56] References Cited

U.S. PATENT DOCUMENTS

| | | | |
|---|---|---|---|
| D. 328,119 | 7/1992 | Matsch | D21/244 |
| D. 344,317 | 2/1994 | Petersheim | D21/244 |
| 2,465,187 | 3/1949 | Barrabee | 472/116 |
| 4,805,898 | 2/1989 | Jacober et al. | 472/117 |
| 5,230,662 | 7/1993 | Langford | 472/117 |

*Primary Examiner*—Kien T. Nguyen

[57] ABSTRACT

An angle adjustable tubular waterslide comprises a tube slide formed in a hollow generally cylindrical configuration with an interior surface, an exterior surface and two open ends, the tube slide having a diameter sufficiently large to comfortably receive a child therein, the tube including a water spray device coupled thereto, the water spray device permitting the introduction of water into the interior of the tube, the water reducing the frictional forces encountered by children while sliding down the tube slide; and a frame comprised of a plurality of poles, the frame including support means coupled to the frame and the tube, the support means permitting the user to pitch the tube slide at varying angles to allow gravitational forces to act on a child positioned within the higher end of the tube, the child easily sliding down the angled water treated interior of the tube.

5 Claims, 5 Drawing Sheets

ANGLE ADJUSTABLE TUBULAR WATERSLIDE

RELATED APPLICATION

The present invention is a continuation-in-part of application Ser. No. 08/420,144 filed Apr. 11, 1995 now abandoned.

BACKGROUND OF THE INVENTION

1. Field of the Invention

The present invention relates to a angle adjustable tubular waterslide and more particularly pertains to entertaining children by permitting water aided slidable movement through the apparatus.

2. Description of the Prior Art

The use of tube slides is known in the prior art. More specifically, tube slides heretofore devised and utilized for the purpose of entertaining users by permitting slidable movement down the slides are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. Des. 328,119 to Matsch a tube slide.

U.S. Pat. No. Des. 303,826 to Aker discloses a combined climber and slide for children.

U.S. Pat. No. Des. 321,922 to Basore et al. discloses a children's playground slide.

U.S. Pat. No. 4,487,411 to Ahrens discloses a playground tube slide.

Lastly, U.S. Pat. No. Des. 330,744 to Matsch discloses a combined amusement tube slide and an enclosing structure.

In this respect, the angle adjustable tubular waterslide according to the present invention substantially departs from the conventional concepts and designs of the prior art, and in doing so provides an apparatus primarily developed for the purpose of entertaining children by permitting water aided slidable movement through the apparatus.

Therefore, it can be appreciated that there exists a continuing need for a new and improved angle adjustable tubular waterslide which can be used for entertaining children by permitting water aided slidable movement through the apparatus. In this regard, the present invention substantially fulfills this need.

SUMMARY OF THE INVENTION

In view of the foregoing disadvantages inherent in the known types of tube slides now present in the prior art, the present invention provides an improved angle adjustable tubular waterslide. As such, the general purpose of the present invention, which will be described subsequently in greater detail, is to provide a new and improved angle adjustable tubular waterslide and method which has all the advantages of the prior art and none of the disadvantages.

To attain this, the present invention essentially comprises a new and improved angle adjustable tubular waterslide a frame formed of a plurality of poles and configured as a generally rectangular shaped box with a front end and a rear end, the frame comprising four vertical short poles, four horizontal short poles and two upper long poles and two lower long poles, each pole being formed in a generally cylindrical configuration with two open ends, the four vertical short poles being positioned vertically at each corner of the frame, the two upper long poles each being coupled horizontally between the uppermost extents of two vertical short poles, each of the upper long poles including a plurality of pole eyelets molded thereto at uniformly spaced intervals, the two lower long poles each being coupled horizontally between the lowermost extents of two vertical short poles, the four horizontal short poles being coupled horizontally between the vertical short poles, the horizontal short poles being positioned perpendicular to the long poles to add strength and stability to the apparatus, a plurality of generally rectangular shaped steps being coupled to the front end of the frame, the steps being positioned horizontally one above the other, the steps permitting users to easily enter the apparatus, a semi-rigid runner fabricated of slick plastic being affixed to the lowermost extent of the rear end of the frame, the runner being about seventy five percent of the length of the frame, the runner being formed in a planar generally oval configuration; and a tube slide fabricated of a thick foldable plastic and formed in a hollow generally cylindrical configuration with an interior surface, an exterior surface, a front open end and a rear open end, the tube slide having a diameter sufficiently large to comfortably receive a child therein, the front end of the tube having a generally planar water spray device affixed thereto, the water spray device including a plurality of apertures and coupling means to permit coupling with a garden hose, water entering the water spray device from a garden hose and dispersing within the interior of the tube slide in the operative orientation, the water reducing the frictional forces encountered by children while sliding down the tube slide, a plurality of tube slide eyelets being molded to each side of the tube at uniformly spaced intervals, a plurality of bungee cords having two free ends, a first free end of each cord being coupled to a pole eyelet on one of the upper long poles of the frame, a second free end of each cord being coupled to a tube slide eyelet of the tube, the frontwardmost cord having a shorter length than the rearwardmost cord with the remaining cords having a gradually increasing length therebetween, the tube being positioned in a downwardly angled orientation from front to rear, the angle of the tube being adjustable by shortening or elongating the bungee cords of the apparatus.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved angle adjustable tubular waterslide which has all of the advantages of the prior art tube slides and none of the disadvantages.

It is another object of the present invention to provide a new and improved angle adjustable tubular waterslide which may be easily and efficiently manufactured and marketed.

It is further object of the present invention to provide a new and improved angle adjustable tubular waterslide which is of durable and reliable constructions.

An even further object of the present invention is to provide a new and improved angle adjustable tubular waterslide which is susceptible of a low cost of manufacture with regard to both materials and labor, and which accordingly is then susceptible of low prices of sale to the consuming public, thereby making such angle adjustable tubular waterslide economically available to the buying public.

Still yet another object of the present invention is to provide a new and improved angle adjustable tubular waterslide which provides in the apparatuses and methods of the prior art some of the advantages thereof, while simultaneously overcoming some of the disadvantages normally associated therewith.

Still another object of the present invention is to entertain children by permitting water aided slidable movement through the apparatus.

Lastly, it is an object of the present invention to provide a new and improved angle adjustable tubular waterslide comprises a tube slide formed in a hollow generally cylindrical configuration with an interior surface, an exterior surface and two open ends, the tube slide having a diameter sufficiently large to comfortably receive a child therein, the tube including a water spray device coupled thereto, the water spray device permitting the introduction of water into the interior of the tube, the water reducing the frictional forces encountered by children while sliding down the tube slide; and a frame comprised of a plurality of poles, the frame including support means coupled to the frame and the tube, the support means permitting the user to pitch the tube slide at varying angles to allow gravitational forces to act on a child positioned within the higher end of the tube, the child easily sliding down the angled water treated interior of the tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
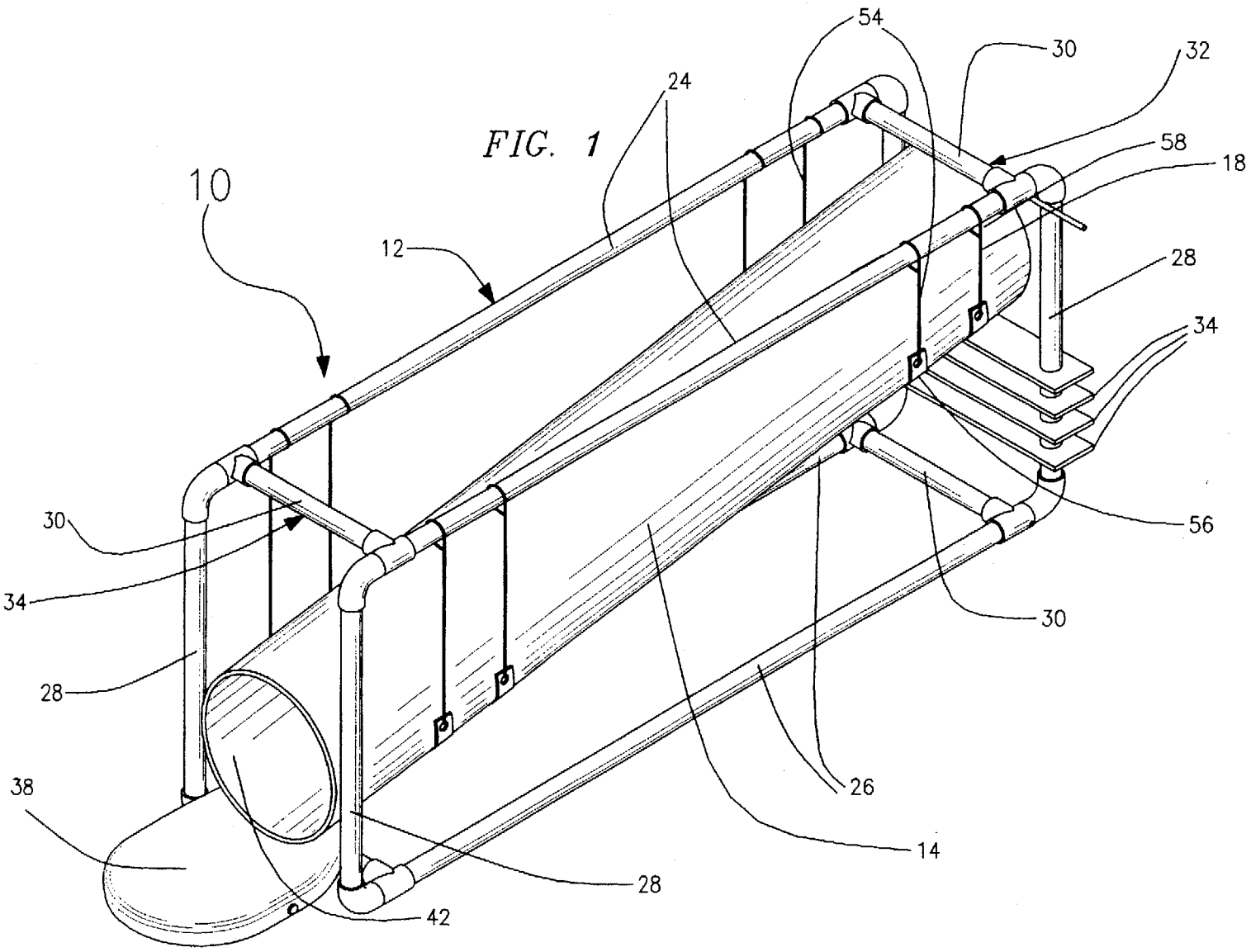
FIG. 1 is a perspective view of the preferred embodiment of the angle adjustable tubular waterslide constructed in accordance with the principles of the present invention.

With reference now to the drawings, and in particular to FIG. 1 thereof, the preferred embodiment of the new and improved angle adjustable tubular waterslide embodying the principles and concepts of the present invention and generally designated by the reference numeral 10 will be described.

The present invention, the angle adjustable tubular waterslide 10 is comprised of a plurality of components. Such components in their broadest context include a frame 12, a tube 14, a water spray device 16 and a plurality of bungee cords 18. Such components are individually configured and correlated with respect to each other so as to attain the desired objective.

Figure 2:
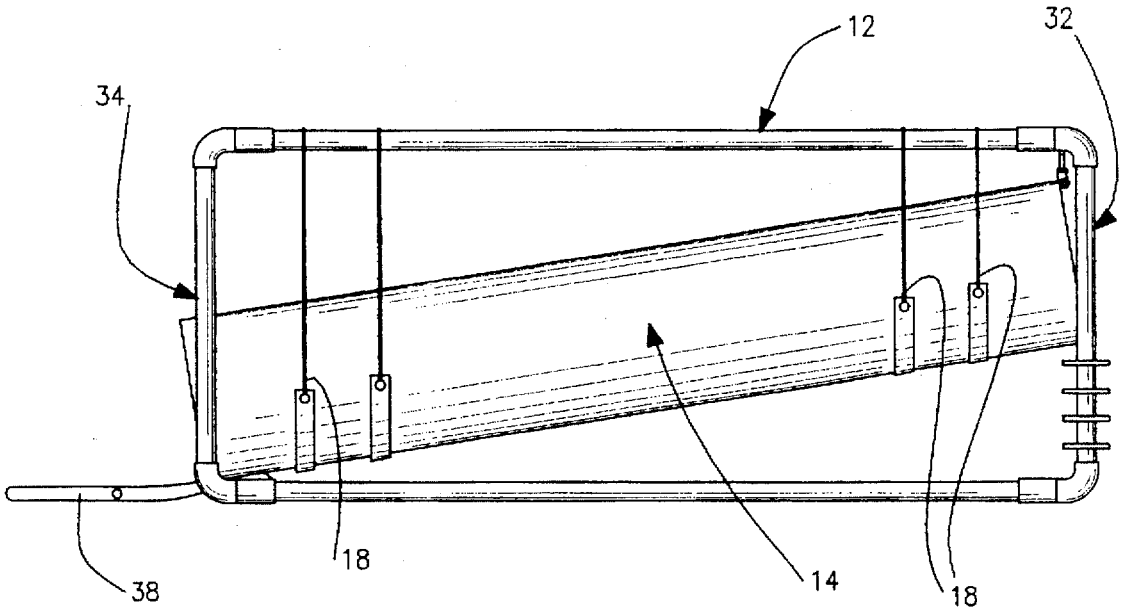
FIG. 2 is a side perspective view of the apparatus shown in FIG. 1.
Figure 6:
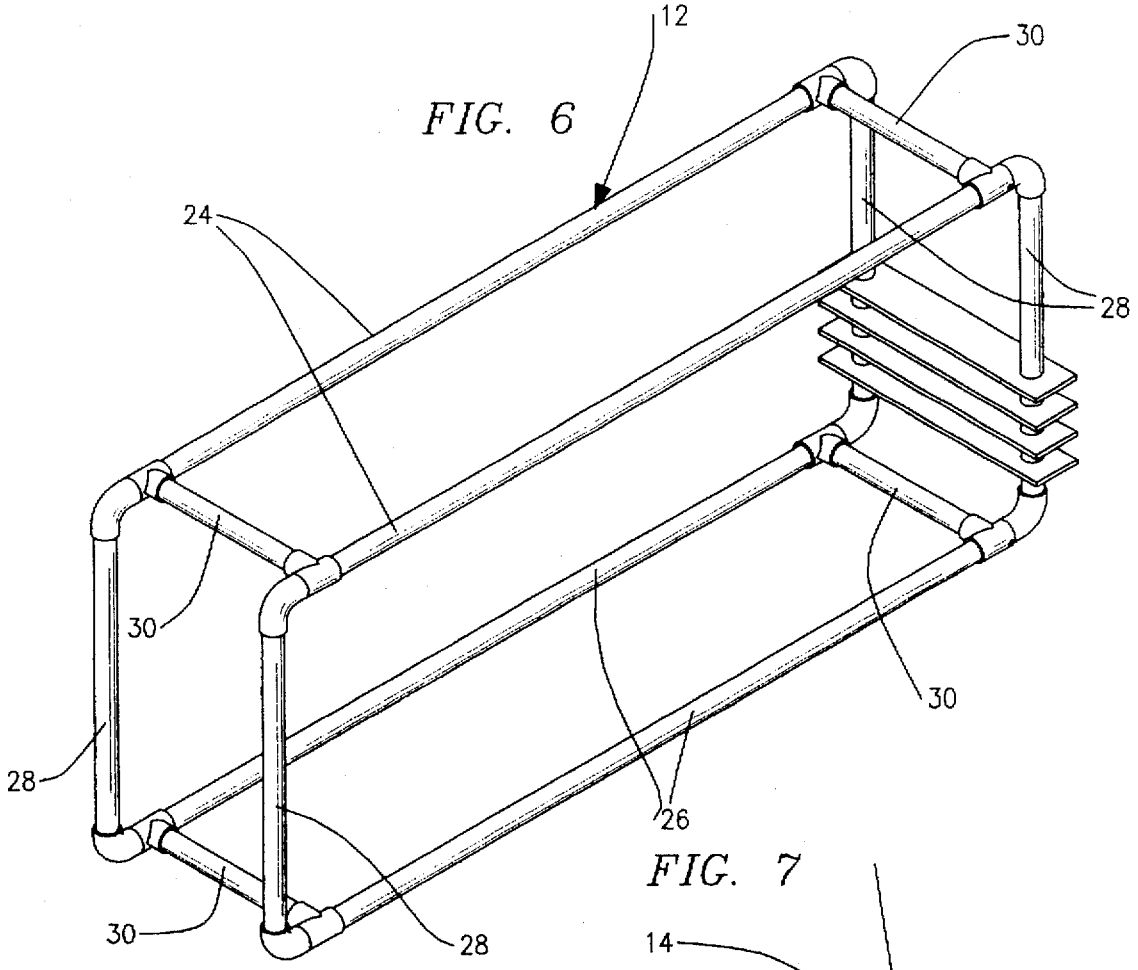
FIG. 6 is a perspective view of the frame separated from the tube slide of the apparatus.

More specifically, the frame 12 is formed of a plurality of poles 24, 26, 28, 30 and configured as a generally rectangular shaped box. The frame has a front end 32 and a rear end 34. The frame comprises eight short poles 28, 30 and four long poles 24, 26. Each pole is fabricated of sturdy materials, preferably plastic, and formed in a generally cylindrical configuration with two open ends. Four short poles 28 are positioned vertically at each corner of the frame. Two upper long poles 24 are each coupled horizontally between the uppermost extents of two of the short vertical poles. The upper poles 24 include a plurality of eyelets molded in a suspended orientation at uniformly spaced intervals of about twelve inches. Two lower long poles 26 are each coupled horizontally between the lowermost extents of two of the short vertical poles. In one embodiment of the apparatus the poles are coupled together with elbow connectors. In another embodiment the poles are welded together. Note FIGS. 1, 2 and 6.

Figure 3:
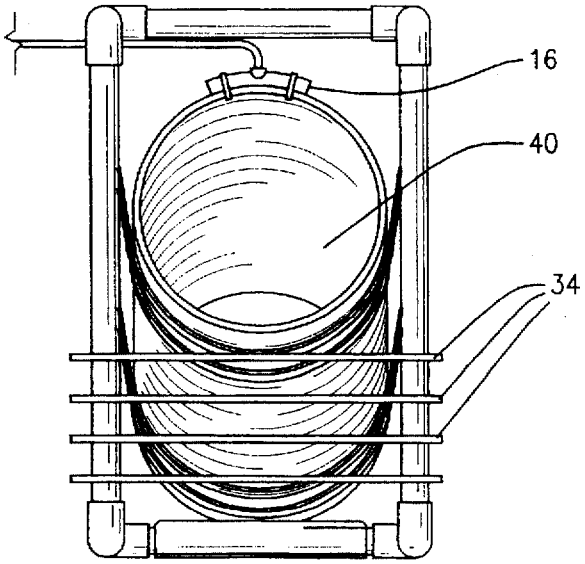
FIG. 3 is a front perspective view of the apparatus shown in FIG. 1.

Four short poles 30 are coupled horizontally between the short vertical poles 28. The short horizontal poles are positioned perpendicular to the long horizontal poles 24, 26. The short horizontal poles couple the two sides of the frame together thereby adding strength and stability to the apparatus. A plurality of generally rectangular shaped steps 34 are coupled to the front end of the frame. The steps are positioned horizontally one above the other. Note FIG. 3. The steps permit children to easily climb and enter the apparatus.

Figure 4:
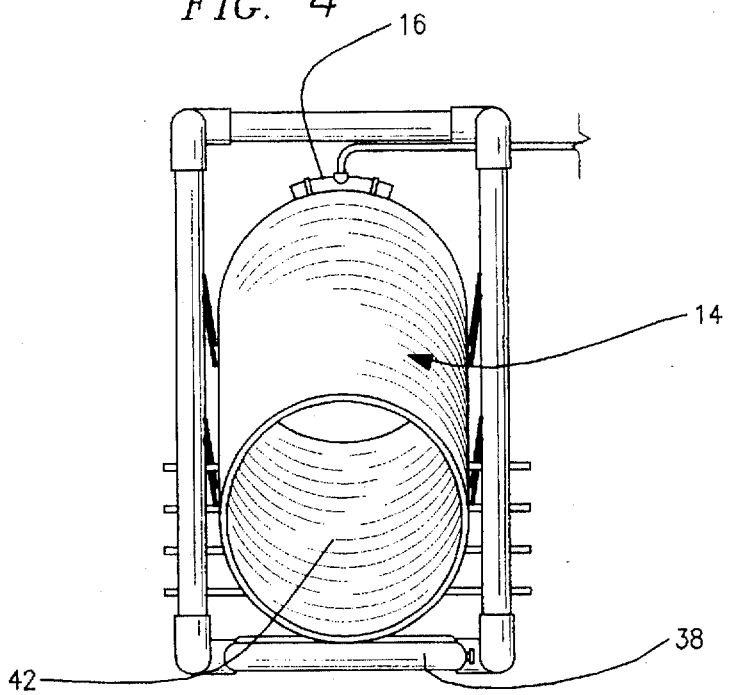
FIG. 4 is a rear perspective view of the apparatus shown in FIG. 1.
Figure 7:
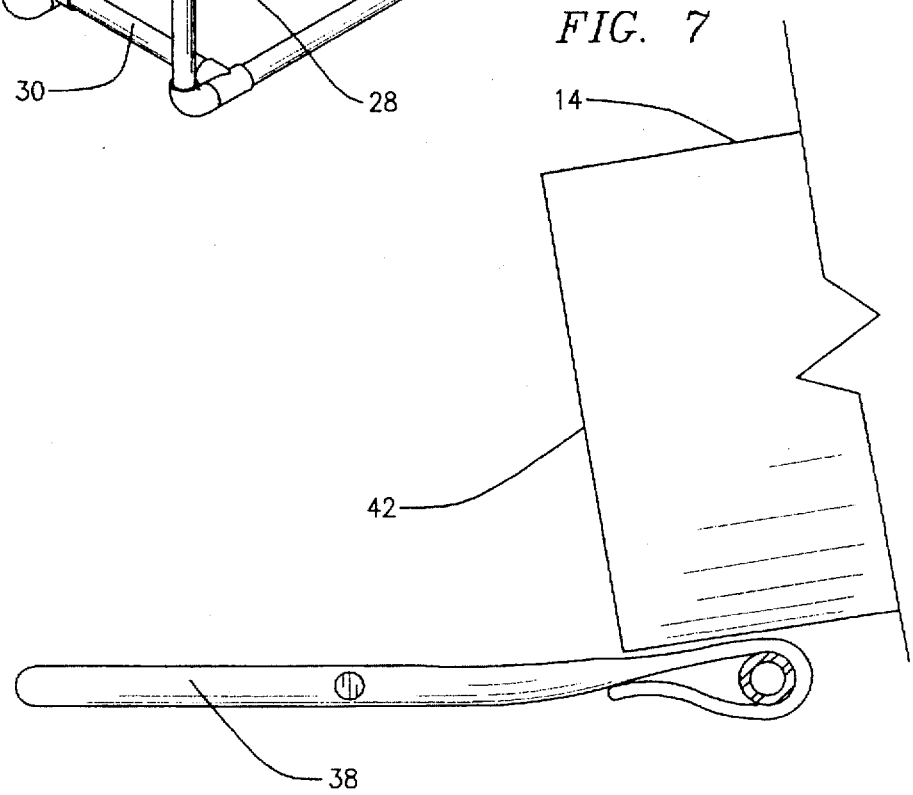
FIG. 7 is a side perspective view of the rear end of the tube illustrating its positioning above the runner of the apparatus.

A semi-rigid runner 38 is fabricated of slick plastic and affixed to the lowermost extent of the rear end of the frame. The runner is formed in a planar generally oval configuration and extends about seventy five percent of the length of the frame. Exiting water travels across the runner and over the cushion thereby providing a slick landing surface for children when exiting the apparatus. The runner effectively increases the length of the apparatus since it extends a significant distance outside the tube. Note FIGS. 1, 4 and 7.

A tube slide 14 is fabricated of thick foldable plastic and formed in a hollow generally cylindrical configuration. The sturdy foldable plastic construction of the tube slide makes it both light weight and safe for use by children. The tube may be folded into a concise package for stocking on shelves. The flexible tube allows users to position it in a plurality of sloped orientations. There are no sharp metal edges to cause injuries such as those found on many conventional slides. The tube slide has an interior surface, an exterior surface, a front open end 40 and a rear open end 42. The tube slide has a diameter sufficiently large to comfortably receive a child within it. The tube is angled from front to rear. Children enter the tube from the front and slide downward. In alternative embodiments of the apparatus the tube slide includes one or more curved regions. Note FIGS. 1 and 3.

Figure 8:
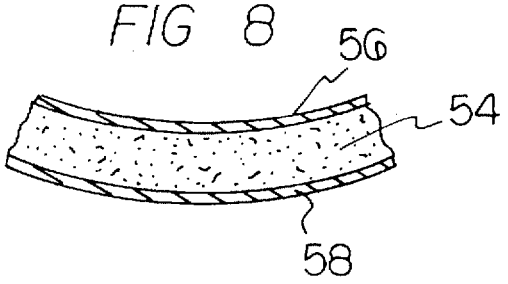
FIG. 8 is a cross sectional view of a portion of the slide shown in the prior Figures.

As shown in FIG. 8, the slide tube itself is preferably fabricated of an elastomeric foam which is semirigid in nature and conformable into a cylindrical configuration for operation and use. It is sufficiently flexible as to allow it to be bent and folded for transportation. In the preferred embodiment, the foam is between about one and three inches in thickness of a closed cell polyurethane foam 54. Its interior and exterior surface are preferably coated with a lubricous material 56, 58. A preferred lubricous material is Teflon. This allows for ease of sliding of a user during operation and use. Other analogous materials could, however, be readily utilized.

Figure 5:
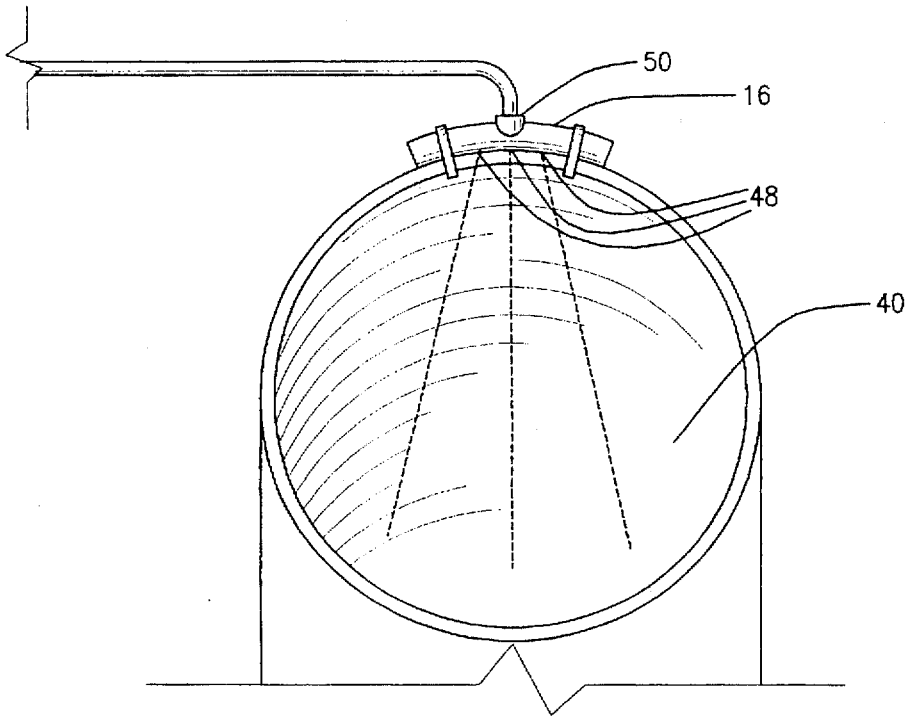
FIG. 5 is an enlarged perspective view of the front end of the tube illustrating the positioning of the water spray device.

The front end of the tube has a generally planar shaped water spray device 16 affixed to it. The water spray device is mounted to the uppermost portion of the tube. The water spray device includes a plurality of apertures 48 and coupling means 50 to permit coupling with a garden hose. Water enters the water spray device from a garden hose and disperses within the interior of the tube slide in the operative orientation. Note FIG. 5. The water reduces the frictional forces encountered by children when sliding through the tube slide. Children pass through the downwardly dispersing water as they enter the slide. The water provides additional entertainment and serves to cool children off on a hot day. Water exiting the tube covers the cushion and further softens the landing of a child passing through the tube slide. Note FIGS. 3 and 4.

A plurality of a plurality of eyelets 56 are molded to each side of the tube at uniformly spaced intervals of about twelve inches. A plurality of bungee cords 18 each have two free ends. A first free end of each cord is coupled to an eyelet on the upper horizontal pole of the frame. A second free end of each cord 18 is coupled to an eyelet 56 of the tube. The bungee cords may include adjustment means to permit users to easily adjust the length of the cords. The frontwardmost cord has a shorter length than the rearwardmost cord with the remaining cords having a gradually increasing length therebetween. The tube is positioned in a downwardly angled orientation from front to rear. The angle and orientation of the tube are adjustable by shortening or elongating the bungee cords of the apparatus. The flexible tube and bungee cords allow the user to place the apparatus in a plurality of different configurations. Note FIGS. 1 and 2.

If a steep angle is desired the frontward cords would be adjusted to a short length and the rearward cords adjusted to a long length. In alternative embodiments of the apparatus the frame and tube slide are fabricated in a variety of heights, widths and lengths. These embodiments provide users with even greater latitude in configuring and angling the apparatus. Note FIGS. 1 through 4.

The angle adjustable tubular waterslide comprises a tube slide and frame to which a garden hose can be connected. The apparatus provides a fun and safe backyard water slide for children. The slide itself is a tube having a length than can vary based on the preference of the user. An runner extends from the rear end of the slide. The frame is a box constructed of plastic poles coupled together. A set of stairs is positioned at the front end of the frame. The tube is suspended at an angle by a plurality of bungee cords tied to the upper poles of the frame. The front of the tube includes a water spray device which couples with a garden hose.

The height and angle of the tube can be adjusted by lengthening or shortening the cords that hold it in place. The hose is inserted into the nozzle opening in the water spray device of the tube, then turned on. Water comes out of the holes in the device and streams down the inside of the tube. The child walks up the stairs holding the vertical poles on each side, enters the tube, and slides down. The child exits the rear end of the tube and slides across the water coated runner. The runner comfortably and safely stops a sliding child. Children love water slides, but they can enjoy them only at expensive amusement parks. Homemade variations with conventional metal slides are unsafe. The angle adjustable tubular waterslide is safe and easy to assemble. This structure can easily fit within a small backyard.

Figure 9:
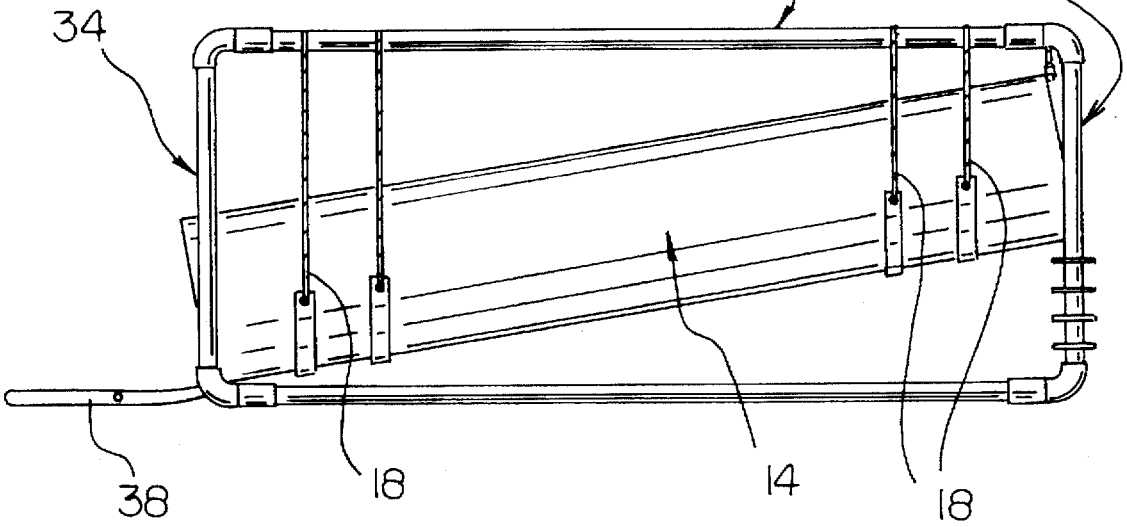
FIG. 9 is a side elevational of the first alternate embodiment of the invention.

FIG. 9 shows a first alternate embodiment of the invention. Figure is similar to FIG. 2 of the primary embodiment except that the flexible, resilient bungee type cords of the primary embodiment are replaced by flexible inelastic cords such as ropes. The ropes may be fabricated of a natural or synthetic material. In this embodiment, the sensation of bouncing up and down during the sliding is not attained as it is in the primary embodiment. Such embodiment allows for lateral swinging while the sliding is taking place by a user.

Figure 10:
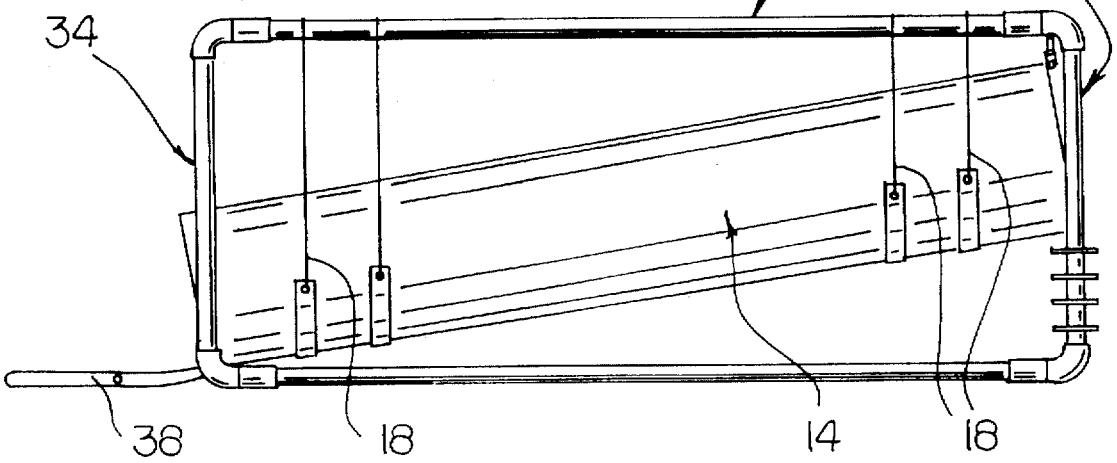
FIG. 10 is a side elevational view of another alternate embodiment of the invention.

In the final embodiment of the invention, that shown in FIG. 10, the construction again is similar to that as shown in the primary embodiment. The significant difference of this embodiment is that the flexible supports of the prior two embodiments are replaced by inflexible rigid supports such as straps fabricated of a rigid plastic or, possibly metallic material. In such embodiment, the user does not experience the bouncing sensation of the primary embodiment nor the lateral swinging of the first alternate embodiment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved angle adjustable tubular waterslide comprising, in combination:

a frame formed of a plurality of poles and configured as a generally rectangular shaped box with a front end and a rear end, the frame comprising four vertical short poles, four horizontal short poles and two upper long poles and two lower long poles, each pole being formed in a generally cylindrical configuration with two open ends, the four vertical short poles being positioned vertically at each corner of the frame, the two upper long poles each being coupled horizontally between the uppermost extents of two vertical short poles, each of the upper long poles including a plurality of pole eyelets molded thereto at uniformly spaced intervals, the two lower long poles each being coupled horizontally between the lowermost extents of two vertical short poles, the four horizontal short poles being coupled horizontally between the vertical short poles, the horizontal short poles being positioned perpendicular to the long poles to add strength and stability to the apparatus, a plurality of generally rectangular shaped steps being coupled to the front end of the frame, the steps being positioned horizontally one above the other, the steps permitting users to easily enter the apparatus, a semirigid runner fabricated of slick plastic being affixed to the lowermost extent of the rear end of the frame, the runner being about seventy five percent of the length of the frame, the runner being formed in a planar generally oval configuration; and a tube slide fabricated of a thick foldable plastic and formed in a hollow generally cylindrical configuration with an interior surface, an exterior surface, a front open end and a rear open end, the tube slide having a diameter sufficiently large to comfortably receive a child therein, the front end of the tube having a generally planar water spray device affixed thereto, the water spray device including a plurality of apertures and coupling means to permit coupling with a garden hose, water entering the water spray device from a garden hose and dispersing within the interior of the tube slide in the operative orientation, the water reducing the frictional forces encountered by children while sliding down the tube slide, a plurality of tube slide eyelets being molded to each side of the tube at uniformly spaced intervals, a plurality of bungee cords having two free ends, a first free end of each cord being coupled to a pole eyelet on one of the upper long poles of the frame, a second free end of each cord being coupled to a tube slide eyelet of the tube, the frontwardmost cord having a shorter length than the rearwardmost cord with the remaining cords having a gradually increasing length therebetween, the tube being positioned in a downwardly angled orientation from front to rear, the angle of the tube being adjustable by shortening or elongating the bungee cords of the apparatus.

2. An angle adjustable tubular waterslide comprising:

a tube slide formed in a hollow generally cylindrical configuration with an interior surface, an exterior surface and two open ends, the tube slide having a diameter sufficiently large to comfortably receive a child therein, the tube including a water spray device coupled thereto, the water spray device permitting the introduction of water into the interior of the tube, the water reducing the frictional forces encountered by children while sliding down the tube slide; and a frame comprised of a plurality of poles, the frame including support means coupled to the frame and the tube, the support means permitting the user to pitch the tube slide at varying angles to allow gravitational forces to act on a child positioned within the higher end of the tube, the child easily sliding down the angled water treated interior of the tube;

wherein the support means is a plurality of resilient cords of different lengths.

3. An angle adjustable tubular waterslide comprising:

a tube slide formed in a hollow generally cylindrical configuration with an interior surface, an exterior surface and two open ends, the tube slide having a diameter sufficiently large to comfortably receive a child therein, the tube including a water spray device coupled thereto, the water spray device permitting the introduction of water into the interior of the tube, the water reducing the frictional forces encountered by children while sliding down the tube slide; and a frame comprised of a plurality of poles, the frame including support means coupled to the frame and the tube, the support means permitting the user to pitch the tube slide at varying angles to allow gravitational forces to act on a child positioned within the higher end of the tube, the child easily sliding down the angled water treated interior of the tube; wherein the support means is a plurality of flexible cords of different lengths.

4. An angle adjustable tubular waterslide comprising:

a tube slide formed in a hollow generally cylindrical configuration with an interior surface, an exterior surface and two open ends, the tube slide having a diameter sufficiently large to comfortably receive a child therein, the tube including a water spray device coupled thereto, the water spray device permitting the introduction of water into the interior of the tube, the water reducing the frictional forces encountered by children while sliding down the tube slide; and a frame comprised of a plurality of poles, the frame including support means coupled to the frame and the tube, the support means permitting the user to pitch the tube slide at varying angles to allow gravitational forces to act on a child positioned within the higher end of the tube, the child easily sliding down the angled water treated interior of the tube;

wherein the support means is a plurality of rigid cords of different lengths.

5. The apparatus as set forth in claim 4 wherein the runner is formed contiguously with the tube slide.

* * * * *